US005280973A

United States Patent [19]

Culling

[11] Patent Number: 5,280,973

[45] Date of Patent: Jan. 25, 1994

[54] HATCH SECURING MECHANISM

[75] Inventor: Robert K. Culling, Rochester Hills, Mich.

[73] Assignee: The United States of America as represented by the Secretary of the Army, Washington, D.C.

[21] Appl. No.: 949,915

[22] Filed: Sep. 25, 1992

[51] Int. Cl.[5] ..... E05C 5/02

[52] U.S. Cl. ..... 292/58; 292/342

[58] Field of Search ..... 292/57-62, 292/302, 58, 59, 61, DIG. 40

[56] References Cited

U.S. PATENT DOCUMENTS

| | | | |
|---|---|---|---|
| 267,539 | 11/1882 | Johnson | 292/58 |
| 549,924 | 11/1895 | Leistner et al. | 292/58 |
| 849,800 | 4/1907 | Louthorp | 292/57 X |
| 901,511 | 10/1908 | Winn | 292/57 X |
| 1,120,521 | 12/1941 | Oborny | 292/61 |
| 1,561,129 | 11/1925 | Weymann | 292/302 X |
| 2,235,949 | 3/1941 | Shaw | 292/59 |
| 2,787,487 | 4/1957 | Baker, Jr. | 292/58 X |
| 2,934,370 | 4/1960 | Love et al. | 292/302 X |
| 3,151,698 | 10/1964 | Pollock | 292/302 X |
| 3,663,989 | 5/1972 | Ellard, Jr. | 292/302 X |
| 4,997,218 | 3/1991 | Culling | 292/DIG. 47 X |
| 5,032,045 | 7/1991 | Calco | 292/61 X |

FOREIGN PATENT DOCUMENTS

| | | | |
|---|---|---|---|
| 396211 | 8/1933 | United Kingdom | 292/61 |
| 651872 | 4/1951 | United Kingdom | 292/58 |

*Primary Examiner*—Richard E. Moore

*Attorney, Agent, or Firm*—Peter A. Taucher; David L. Kuhn

[57] ABSTRACT

A hatch securing mechanisms has a base attached to a hatchway and a hasp attached to a hatch lid. The base has an apertured retainer and a pinway element, the hasp being held between the retainer and pinway element during closure of the lid. A latch pin translatable in the pinway element has an angled tip which slides against a bevelled surface of the hasp to force the hasp into tighter, locked engagement with the base. The latch pin has a helical groove segment about the pin's axis, and a stud fixed to the pinway element engages the groove segment. The interaction of the stud and groove segment effects translation of the latch pin when the pin is manually rotated. The action of the latch pin also compresses an elastically deformable seal between the door and door frame so that the seal is increasingly effective against explosive blast pressures. The invention includes a lock mechanism for keeping the latch pin in a hasp retaining position unless the pin is manually moved.

5 Claims, 5 Drawing Sheets

HATCH SECURING MECHANISM

GOVERNMENT USE

The invention described herein may be manufactured, used and licensed by or for the U.S. Government for governmental purposes without payment to me of any royalty.

PRIOR ART

The closest prior art to the invention herein is believed to be U.S. Pat. No. 4,997,218, issued Mar. 5, 1991 to Robert Culling for a lock mechanism.

BACKGROUND AND SUMMARY

The invention relates to latch mechanisms on vehicles such as tanks and armored personnel carriers, but the invention has other applications as well.

Combat vehicles need to protect their crews from nuclear, biological and chemical agents extant in modern warfare. These vehicles also perform the more traditional function of protecting occupants from explosions and enemy fire. Hatches and doors on combat vehicles accordingly must withstand the impacts of explosions and projectiles while maintaining a seal against the aforementioned agents. Latches for doors and hatches must maintain positive closure thereof despite the explosive impacts and despite shocks to the vehicle resulting from rapid travel over rough terrain.

I address the above needs via a hatch securing mechanism whose base attaches to a door frame or hatchway and whose hasp attaches to a door or hatch lid. The base defines a retainer and a pinway element between which the hasp stays during closure of the door or lid. A latch pin translatable in the pinway element has a tip slidable against a bevelled surface of the hasp. The tip's sliding motion forces the hasp into tighter, locked engagement with the base. A groove segment on the latch pin spirals about the pin's axis, and a stud in the pinway element tracks the groove segment such that rotating the pin effects its translation. The action of the latch pin also compresses an elastically deformable seal between the door and door frame so that the seal is increasedly effective against explosive blast pressures. Lock means are provided for keeping the latch pin in a hasp retaining position unless the pin is manually moved.

DETAILED DESCRIPTION

Figure 1:
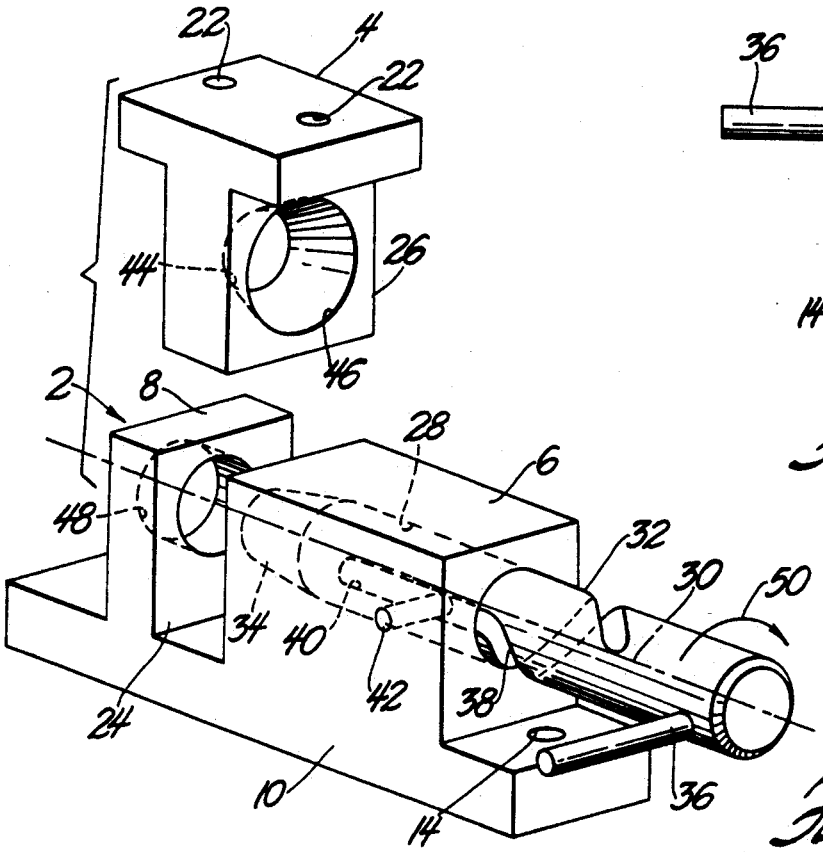
FIG. 1 is a perspective view of a first embodiment of my hatch securing mechanism.
Figure 2:
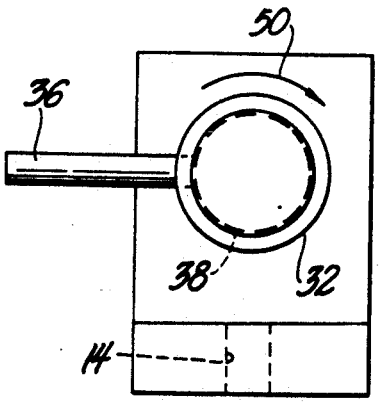
FIG. 2 is an end elevational view of the base of the securing mechanism shown in FIG. 1.
Figure 3:
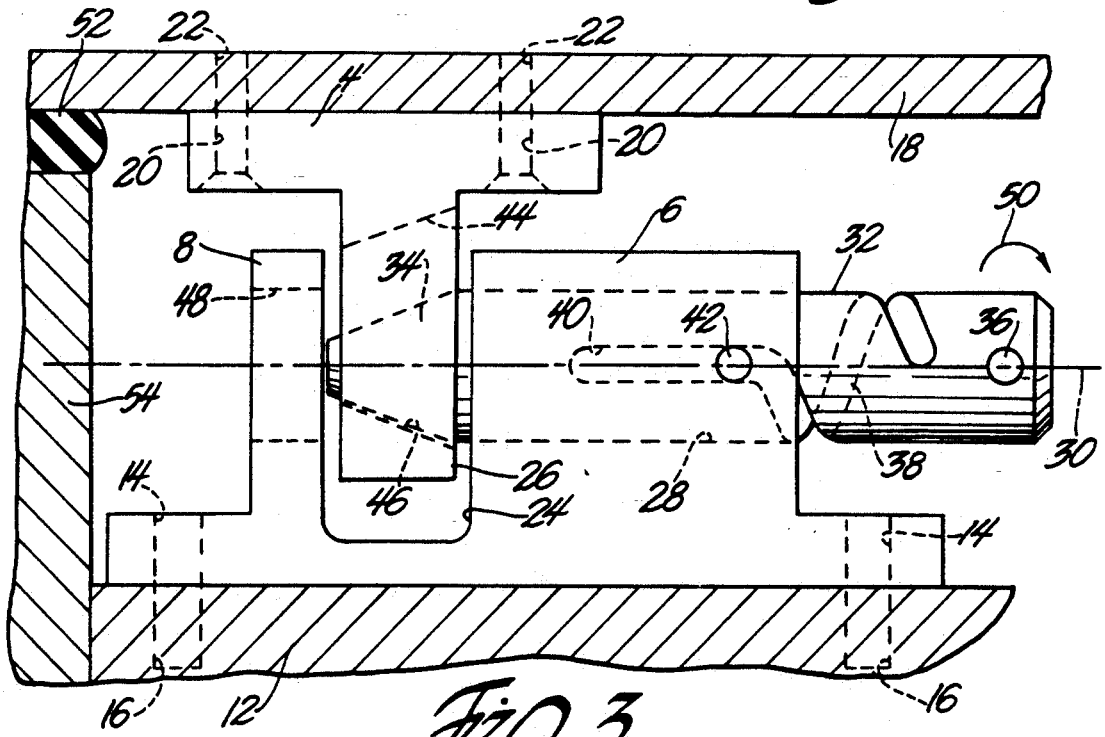
FIG. 3 is a side elevational view of the first embodiment of my securing mechanism together with surrounding structure.

In FIGS. 1 and 3 shown a hatch securing mechanism 2 whose base 10 is fixed to a first structural member 12, which is typically a doorway frame or a hatchway frame. Base 10 is attached to member 12 by any suitable means such as welding or such as bolts (not shown) in axially aligned pairs of holes 14 and 16. Integral with base 10 are pinway element 6 and retainer 8 that together define a rectangular gap 24 receiving insert 26 of hasp 4. Hasp 4 attaches to a second structural member 18, which is typically a hatch cover or door. Hasp 4 is attached to member 18 by suitable means such as welding or such as bolts (not shown) in axially aligned pairs of holes 20 and 22. It will be understood that hasp 4 can alternately be attached to first structural member 12 and base 10 can be attached to second structural member 18.

Pinway element 6 defines a cylindrical void or through bore 28 centered on axis 30. Latch pin 32 closely and coaxially fits in bore 28 such that latch pin 32 can both translate and rotate in bore 28. The end of pin 32 nearer retainer 8 is a frusto-conical tip 34 and the opposite end of pin 32 has a radially extending handle 36. Between the ends of latch pin 32, at the outer peripheral surface thereof, is a two-part groove having a spiralled groove portion 38 nearer handle 36 and a straight groove portion 40 nearer frusto-conical tip 34, straight groove portion being parallel to axis 30. A metal stud 42 fits tightly in a sidewall of pinway element 6, one end of stud 42 protruding inwardly relative to axis 30 to engage the two-part groove. The other end of stud 42 protrudes radially outward from the sidewall of pinway element 6.

Hasp 4 defines a round tapered orifice 44 through insert 26, the smaller end of the orifice faced toward retainer 8 in FIG. 3 and the larger end of the orifice faced toward pinway element 6. Preferably, the taper angle of orifice 44 is the same as the taper angle of frusto-conical tip 34 of latch pin 32, whereby tip 34 has line sliding contact with orifice 44 as at 46 when the tip passes through orifice 44. The diameter of the smaller end of orifice 44 is the same as bore 28 of pinway element 6, so that the smaller end of orifice 44 closely engages latch pin 32 after latch pin 32 translates to the left in FIG. 3.

Structural element 18 is released from structural element 12 by sliding pin 32 right until the end of straight groove portion 40 nearer hasp 4 engages stud 42. On the other hand, locking structural element 18 to structural element 12 is accomplished by first sliding pin 32 to the left in FIG. 3 until pin 42 engages spiralled groove portion 38 and then using handle 36 to rotate pin 32 in direction 50. Due to the engagement of stud 42 with spiralled groove portion 38, the rotation of pin 32 in direction 50 translates pin 32 further to the left. Frusto-conical tip 34 of pin 32 slides on the tapered inner diametrical surface of orifice 44 at 46, whereby hasp 4 and structural element 18 are forced toward structural element 12, thereby elastically compressing seal 52 between structural element 18 and structural element 54. The pitch of spiralled groove section 38 is selected so that the friction between stud 42 and groove section 38 prevents pin 32 from now translating rightward unless a person turns handle 36 in the reverse of direction 50. When latch pin 32 is in the fully leftward, locked position, the portion of the cylindrical outer diametrical surface of pin 32 adjacent frusto-conical tip 42 will be closely received in a short cylindrical aperture 48 in rertainer 8.

Figure 4:
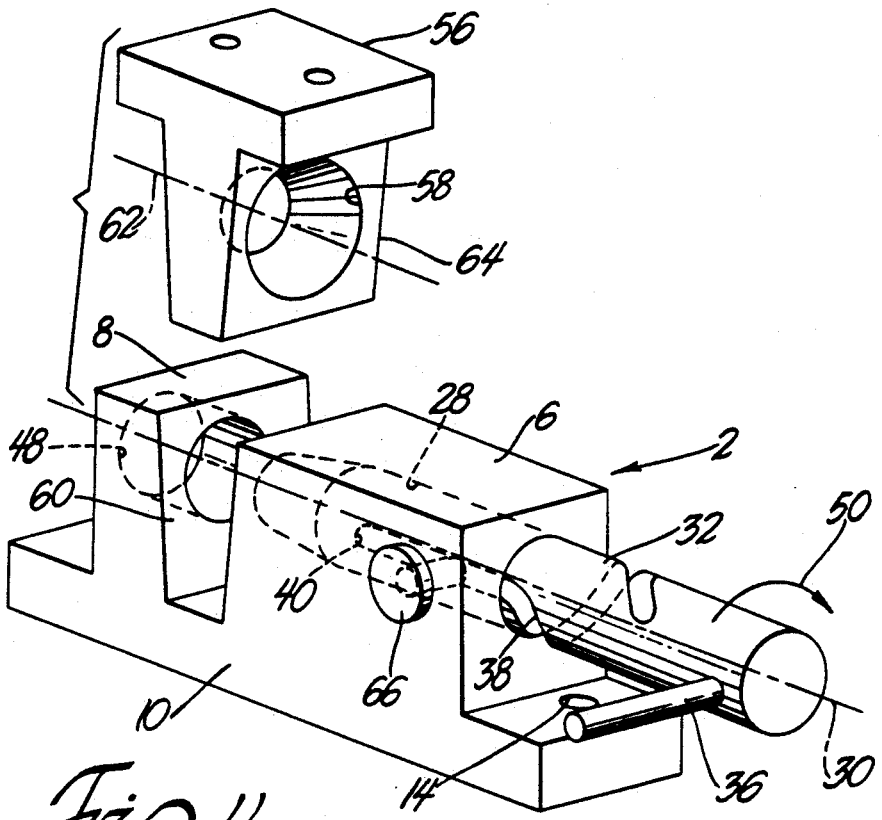
FIG. 4 is a perspective view of of a second embodiment of my securing mechanism.

FIG. 4 shows optional modifications to hatch securing mechanism 2 wherein hasp 56 replaces hasp 4 and tapered gap 60 replaces rectangular gap 24. Hasp 56 comprises an insert 64 having tapered orifice 58 therethrough centered on axis 62. The sides of insert 64 form an angle which is the same as the angle of taper of gap 60 so that the sides of insert 58 bear against the sides of gap 60 when axis 62 of orifice 58 aligns with axis 30 of bore 28. Also shown in FIG. 4 is a knurl headed set screw 66 which replaces stud 42 in FIG. 1. Turning set screw 66 tightens or loosens it engagement with groove portion 38 or 40 and set screw 66 can be used to lock latch pin 32 in a desired position in pinway element 6.

Figure 5:
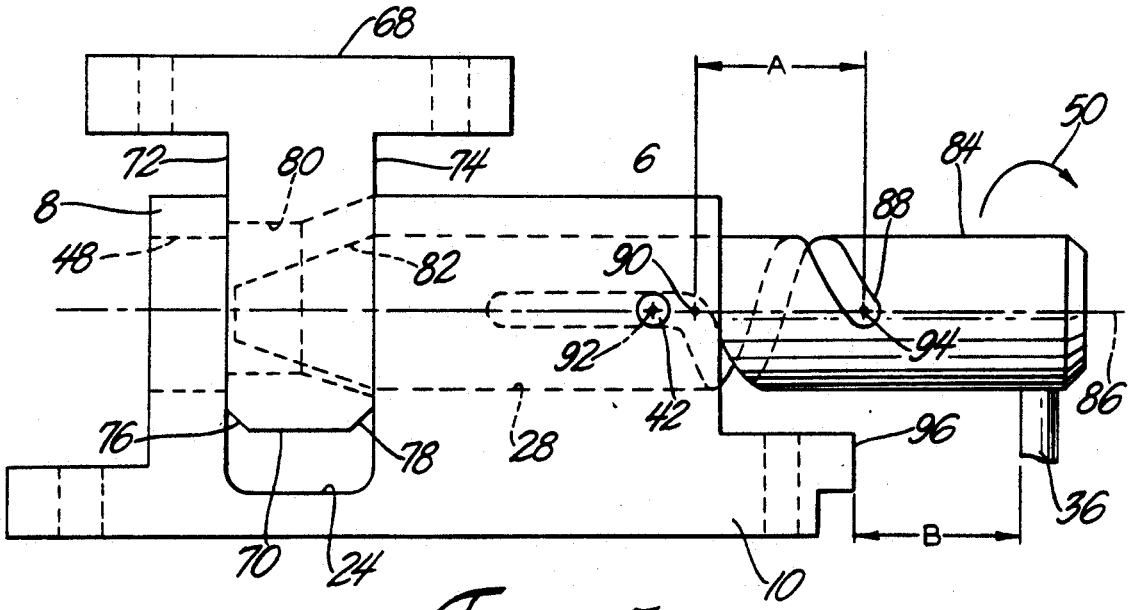
FIG. 5 is a side elevational view of a third embodiment of my securing mechanism.

FIG. 5 shows modifications to hatch securing mechanism 2 designed to maximize the mechanism's ability to act as a solid structural connection between a door or hatch lid and a complimentary doorway or hatchway. In FIG. 5, hasp 68 replaces hasp 4 of FIG. 1. Insert 70 of hasp 68 has straight parallel walls 72 and 74 that are closely received in gap 24 and has bevels 76 and 78 that help guide insert 70 into gap 24 when hasp 68 is first approaching gap 24. Extending through insert 70 is a hole having a flared hole portion 82 diverging toward pinway element 6 and having a straight cylindrical hole portion 80 opening at wall 72. Straight cylindrical hole portion 80 has the same inner diameter as aperture 48 in retainer 8 and bore 28 in pinway element 6. After pin 84 rotates and translates along axis 86 leftward through distance "A" from its FIG. 5 position, the straight cylindrical portion of pin 84 will be closely received in complementary straight cylindrical surfaces of aperture 48 and hole portion 80.

The close fit of hasp 68 in gap 26 and the close fit of pin 84 with straight cylindrical portion 80 eliminates most possible relative movement between the door and doorway to which hasp 68 and base 10 are respectively attached. Such reduction of relative movement allows a door to support a vehicle frame in much the same way, for example, that the rear doors of a semi trailer support the frame of the trailer.

Still referring to FIG. 5, spiralled groove portion 88 has point 90 at one end thereof. Axis 92 of stud 42 aligns with point 90 when stud 42 first engages spiralled groove portion 88. At the other end of groove portion 88 is point 94 with which axis 92 aligns when the other end of groove portion is engaged by stud 42. There is a first distance "A" between points 90 and 94, and a second, slightly smaller distance "B" between end face 96 and handle 36, which extends straight downward in FIG. 5. When handle 36 rotates approximately 360 degrees in direction 50, point 94 approaches stud 42 and handle 36 will have moved through distance "B" and will bear frictionally against end face 96. Upon slight further rotation of handle in direction 50, handle 36 interferingly engages end face 96, whereby latch pin 84 is locked in position in pinway element 6. Thus in FIG. 5, handle 36 acts as a locking means for hatch securing mechanism 2.

Figure 6:
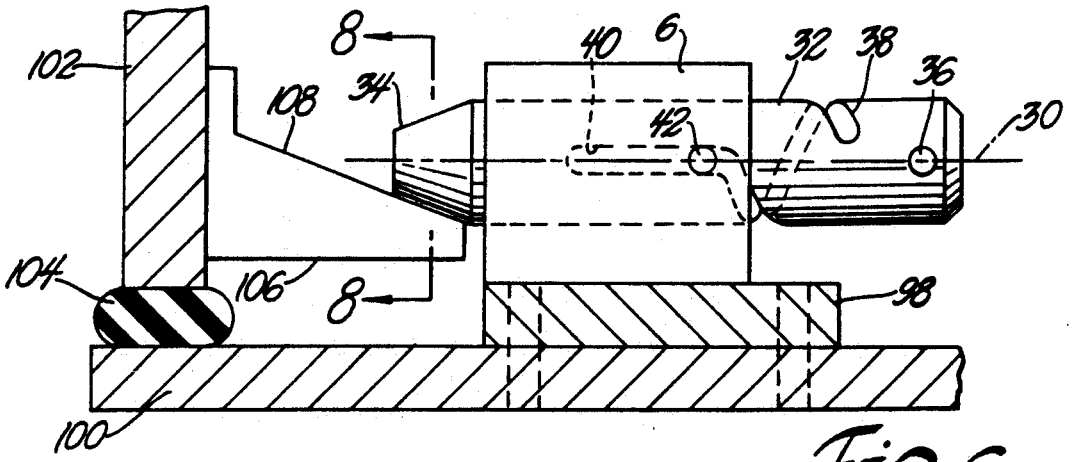
FIG. 6 is a side view of a fourth embodiment of my securing mechanism.

Shown in FIG. 6 is another embodiment of my hatch securing mechanism wherein door or lid 102 is to be secured to doorway frame member 100, there being an elastically deformable seal 104 compressed between lid 102 and frame member 100. Base 98 is suitably bolted or welded to frame member 100 and has pinway element 6 mounted integrally thereto. Latch pin 32 rotates and translates in element 6 in the same fashion as in the previous embodiments. A projection 106 is fastened to lid 102 and protrudes into engagement with latch pin 32, whereby oblique surface 108 is in line contact with frusto-conical tip 34 of pin 32. As pin 32 advances leftward in FIG. 6, tip 34 slides on surface 108, whereby lid 102 is caused to compress seal 104. Translation of pin 32 all the way to the right frees projection 106 from pin 32 so that door 102 may be moved away from frame member 100.

Figure 7:
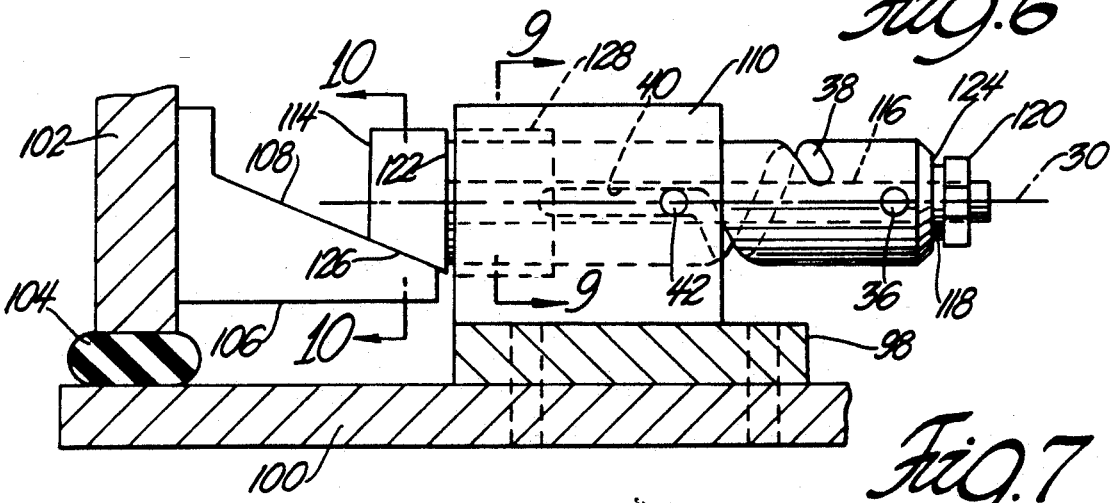
FIG. 7 is a side elevational view of a fifth embodiment of my securing mechanism.
Figure 8:
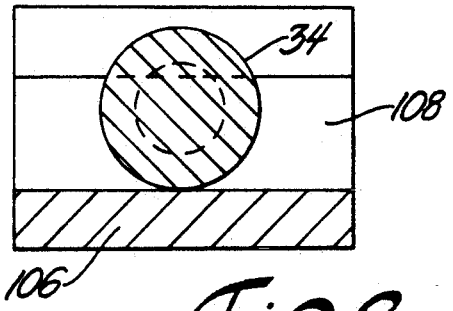
FIG. 8 is a view taken along line 8—8 in FIG. 6.
Figure 9:
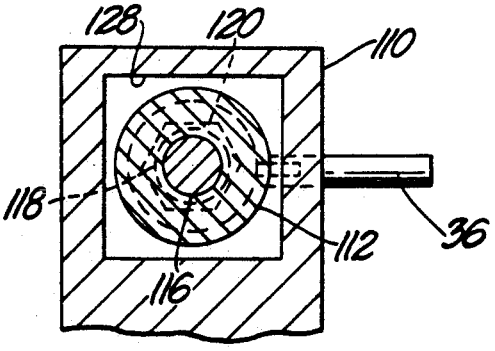
FIG. 9 is a view taken along line 9—9 in FIG. 7.
Figure 10:
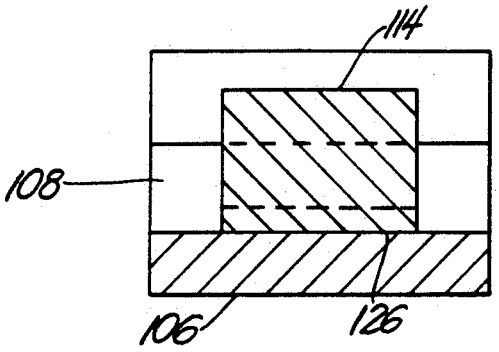
FIG. 10 is a view taken along line 10—10 in FIG. 7.

FIG. 7 shows a modification of the FIG. 6 embodiment wherein modified pinway element 110 replaces pinway element 6 and modified latch pin 112 replaces latch pin 32. Rotatingly bearing against one end 122 of pin 112 is tapered block 114 whose angled surface 126 is in face-to-face contact with oblique surface 108. Block 114 is mounted on round shaft 116 coaxially extending through pin 112, pin 112 being rotatable upon shaft 116 about axis 30. Shaft 116 is secured to latch pin 112 by nut 120, there being an anti-friction bushing 118 disposed between nut 120 and end 124 of pin 112. When pin 112 translates rightward in FIG. 7 to disengage block 114 from projection 106, block 114 is received in recess 128 in pinway element 110. When pin 112 is translated all the way leftward, nut 120 may be tightened against bushing 118 so that pin can not rotate on shaft 116. Pin 112 is thus translationally fixed so that block 114 is locked with projection 106.

Figure 12:
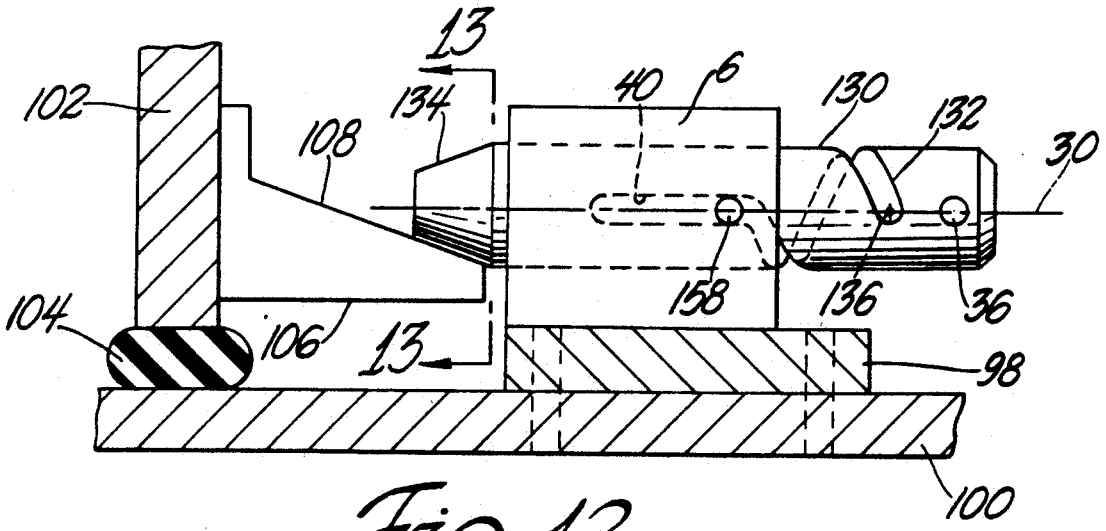
FIGS. 12 and 13 show a modification to the FIG. 6 embodiment of my invention, FIG. 13 being a view taken along line 13—13 in FIG. 12.
Figure 13:
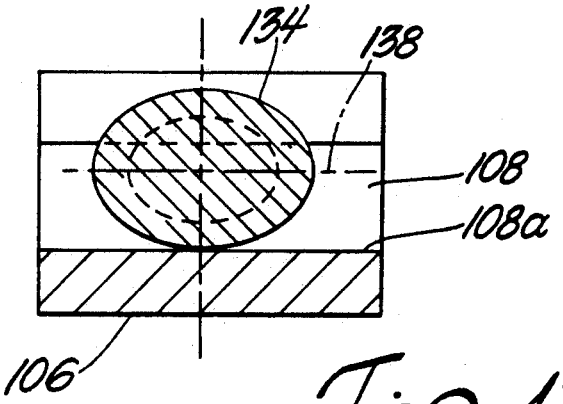
Figure 14:
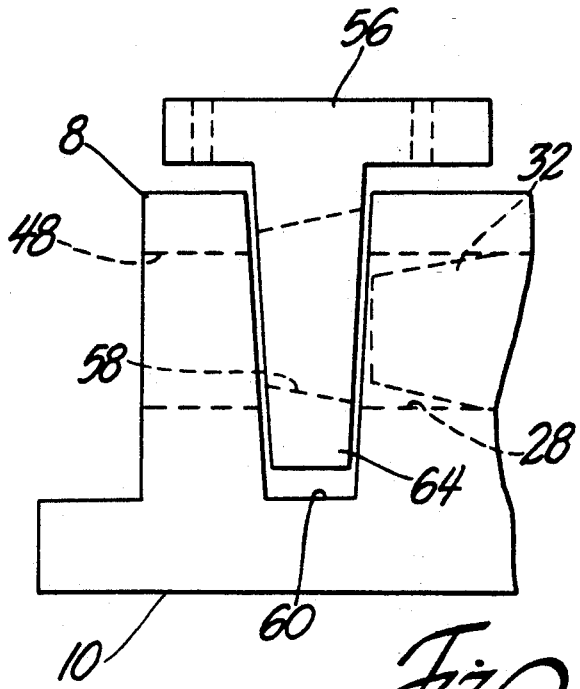
FIG. 14 is a partial side elevational view of the FIG. 4 embodiment of my invention showing an insert almost all of the way into a complimentary gap.
Figure 15:
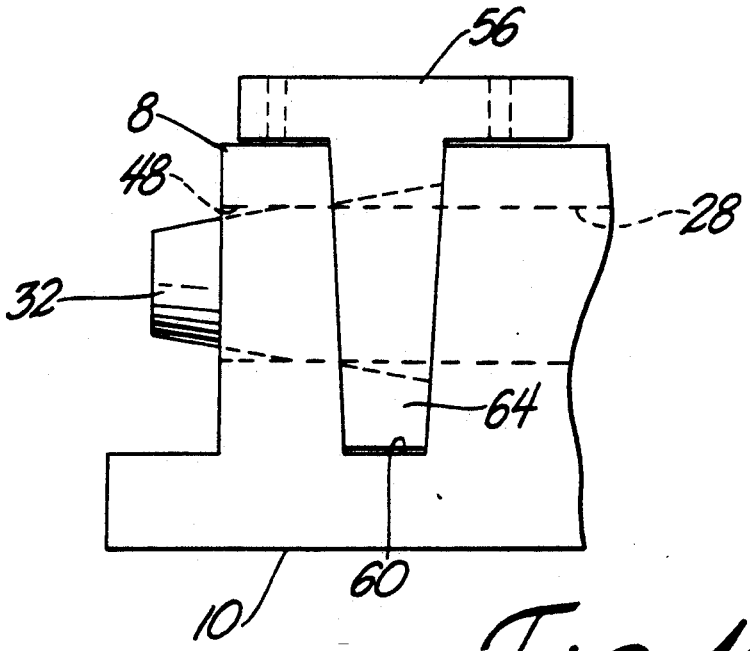
FIG. 15 is a partial side elevational view of the FIG. 4 embodiment of my invention showing an insert all of the way into the complimentary gap and bearing against the sides thereof.

FIG. 12 shows another modification of the FIG. 6 embodiment wherein latch pin 130 replaces latch pin 6. Latch pin 130 has a spiralled groove portion 132 that is a bit longer than its FIG. 6 counterpart and has a cross-sectionally oval pin tip 134 instead of the cross-sectionally round pin tip of FIG. 6. At the end of spiralled groove portion 132 is a point 136 which will move into alignment with the longitudinal axis of stud 42 when latch pin 130 is translated all the way to the left in FIG. 12. When latch pin 130 is in the FIG. 12 position, point 136 is in a common plane with axis 30 and the longitudinal axis of stud 42. Both in the FIG. 12 position and when point 163 aligns with the stud's axis, major axis 138 of the cross section of tip 134 (FIG. 13) will parallel the line **108*a* which is the cross section of surface 108. In either position, tip 134 acts as a cam to inhibit latch pin from rotating or translating, whereby tip 134** may be regarded as a means for locking the hatch securing mechanism.

Figure 11:
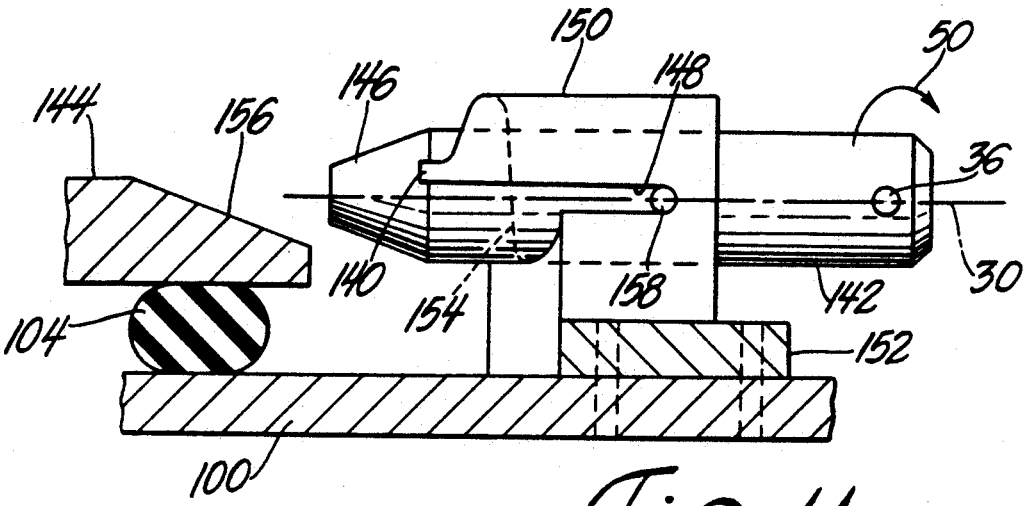
FIG. 11 is a side elevational view of sixth embodiment of my securing mechanism.

FIG. 11 illustrates a final embodiment of the hatch securing mechanism, wherein the mechanism keeps door 144 pressed against seal 104 on frame 100. The mechanism is fastened at base 152 to frame 100 and has a modified pinway element 150, whose helical ramp 154 spirals about axis 30 of latch pin 142. At one end of the helical ramp is a tab 140 that stops the spiral travel of the latch pin's radially projecting stud 158 when the latch pin travels leftward in FIG. 11. At the other end of ramp 154 is a guide slot 148 disposed parallel to axis 30, the purpose of the guide slot being to receive radial stud 158 as that stud departs ramp 154 during rightward movement of latch pin 142 in FIG. 11. At the end of latch pin 142 nearer to door 144 is frusto-conical tip 134 whose angle of taper brings it into line contact with oblique surface 156 of door 144 when latch pin moves left, whereupon seal 104 is compressed.

I wish it to be understood that I do not desire to be limited to the exact details of construction shown and described herein since obvious modifications will occur to those skilled in the relevant arts without departing from the spirit and scope of the following claims.

I claim:

1. A mechanism for latching one structural member to another structural member, comprising:

a base affixed to the one structural member;

a pinway element on the base;

a latch pin translatable in the pinway element along a pinway axis, the latch pin defining at its outer peripheral surface a groove, the groove having one groove portion wound about the pinway axis;

a groove engagement element fastened to the pinway element and extending into the groove on the latch pin;

a hasp fixed to the other structural member;

the hasp defining a hasp hole, one portion of the hasp hole sized to closely and slidingly receive the latch pin such that the latch pin can bearingly rotate and translate in the one portion, the mechanism configurable to a locked condition wherein the latch pin is engaged to the hasp solely by close bearing receipt in the hasp hole;

means external to the hasp hole for reducing mobility of the hasp axially along the pin during the locked condition.

2. The mechanism of claim 1 further comprising a frusto-conical tip on the latch pin, a circumferential surface of the tip oblique to the pin axis at the same angle as another portion of the hasp hole.

3. The mechanism of claim 1 wherein:

the hasp has a plate-like insertion element defining the hasp hole;

the reducing means comprises a retainer on the base having a retainer hole centered on the pinway axis, the retainer defining a gap with the pinway element sized to receive the insert.

4. The mechanism of claim 1, further comprising:

one end of the latch pin;

another end of the latch pin closer to the hasp than the one end of the latch pin;

a handle at the one end of the latch pin;

a lock face on the base;

the latch pin having a first pin position where the handle is removed from the lock face and a second handle position where the one portion of the groove receives the groove engagement element and the handle bears on the lock face;

the handle increasingly interfering with the lock face as the handle is swung about the pinway axis in one angular direction after the latch pin is in the second pin position.

5. The mechanism of claim 3 wherein the insertion element has parallel flat walls, one of the flat walls being in surface contact with the pinway element during the locked condition of the mechanism, another of the flat walls being in surface contact with the retainer during the locked condition of the mechanism.

* * * * *